US005361672A

United States Patent [19]

Koyama

[11] Patent Number: 5,361,672

[45] Date of Patent: Nov. 8, 1994

[54] ELECTRONIC MUSICAL INSTRUMENT WITH HELP KEY FOR DISPLAYING THE FUNCTION OF DESIGNATED KEYS

[75] Inventor: Masahiro Koyama, Hamamatsu, Japan

[73] Assignee: Yamaha Corporation, Hamamatsu, Japan

[21] Appl. No.: 916,185

[22] Filed: Jul. 17, 1992

[30] Foreign Application Priority Data

Jul. 18, 1991 [JP] Japan ..... 3-203867

[51] Int. Cl.[5] ..... G10G 7/00

[52] U.S. Cl. ..... 84/478; 84/600; 395/155

[58] Field of Search ..... 84/478, 477 R, 600; 395/155, 157

[56] References Cited

U.S. PATENT DOCUMENTS 4,992,972 2/1991 Brooks et al. ..... 364/900
5,092,216 3/1992 Wadhams ..... 84/602
5,122,062 6/1992 Cutler et al. ..... 434/327
5,175,812 12/1992 Krieger ..... 395/156
5,179,654 1/1993 Richards et al. ..... 395/157
5,219,291 6/1993 Fong et al. ..... 434/323

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

When a switch is activated while a help switch for designating a help operation is activated, the explanation of a function assigned to the activated switch during a current operation mode is displayed on a display, without executing the function assigned to the activated switch. In an electronic musical instrument of the type having switches whose functions change with the operation mode, it is possible to readily know the function of each switch without relying upon a voluminous manual, and easily know how to manipulate switches in order to realize a desired function.

9 Claims, 12 Drawing Sheets

TUNE SW : TUNE UP/DOWN OF INSTRUMENT USING ⊞, ⊟ KEYS

FIG. 13A

VIOLIN SW : SELECT OF VIOLIN QUALITY

FIG. 13B

EDIT I

SHIFT + VIOLIN : EDIT OF MODULATION FACTOR OF FM OPERATOR

FIG. 13C

MIDI SW : SETUP OF MIDI FUNCTIONS USING TONE QUALITY SWs AND KEYBOARD KEYS

FIG. 13D

ELECTRONIC MUSICAL INSTRUMENT WITH HELP KEY FOR DISPLAYING THE FUNCTION OF DESIGNATED KEYS

BACKGROUND OF THE INVENTION

1. Field of the Invention

The present invention relates to an electronic musical instrument, and more particularly to an electronic musical instrument having a help function for the display of the explanation of a function assigned to each switch.

2. Description of the Related Art

Generally, a manual gives a detailed description of a function assigned to each switch (button) of an electronic musical instrument. A player can know the function of a switch by checking the manual.

Recent electronic musical instruments have versatile functions, and so its manual is voluminous. It is therefore difficult and troublesome for a user to retrieve desired information from such a voluminous manual.

Many electronic musical instruments have a number of switches with various functions and a number of operation modes, and the function off each switch changes with the operation mode many cases. Furthermore, of a number off switches, some switches realize not only particular functions when they are depressed independently from each other, but also a different function when two or more of them are depressed at the same time. For example, when a switch (in some cases a keyboard key) is depressed while depressing a shift key, it is possible to provide a function different from the function obtained when the switch alone is depressed.

A so-called help function is known and used in personal computers and word processors. For example, when a help key is activated or depressed, a help mode is set and an explanation list of functions assigned to keys is displayed on a display screen.

Even if such a help function could be provided to an electronic musical instrument to display an explanation list of switch functions, it would still be difficult and troublesome to find desired information.

SUMMARY OF THE INVENTION

It, is an object of the present invention to provide an electronic musical instrument of the type having switches whose functions change with the operation mode, the instrument being capable off readily knowing the function of each switch without relying upon a voluminous manual, and easily knowing how to manipulate switches in order to realize a desired function.

According to an aspect of this invention, there is provided an electronic musical instrument comprising: operation mode designating means for designating an operation mode among a plurality of operation modes, each defining how said electronic musical instrument operates; a plurality of switch means each assigned different functions with respect to said plural operation modes; display means for displaying information; help designating means for designating a help operation; and control means responsive to activation of said switch means while said help operation is designated, for controlling on said display means to display an explanation of a function assigned to said activated switch in said operation mode, without executing said function.

The plurality of switch means may include a plurality of switches which assign one function when a pair of switches are activated at the same time.

The operation mode designating means designates an operation mode of the electronic musical instrument. Each switch means is assigned a function changing with the operation mode. When each switch means is activated, the function specific to a current operation mode is realized. When each switch means is activated while the help operation is designated by the help designating means, the explanation of a function assigned to the activated switch is displayed on the display means, without executing the function assigned to the activated switch means.

BRIEF DESCRIPTION OF THE DRAWINGS

FIGS. 13A to 13D shows examples of help texts on a display during the help operation.

DESCRIPTION OF THE PREFERRED EMBODIMENTS

Preferred embodiments of the present invention will be described with reference to the accompanying drawings.

Figure 1:
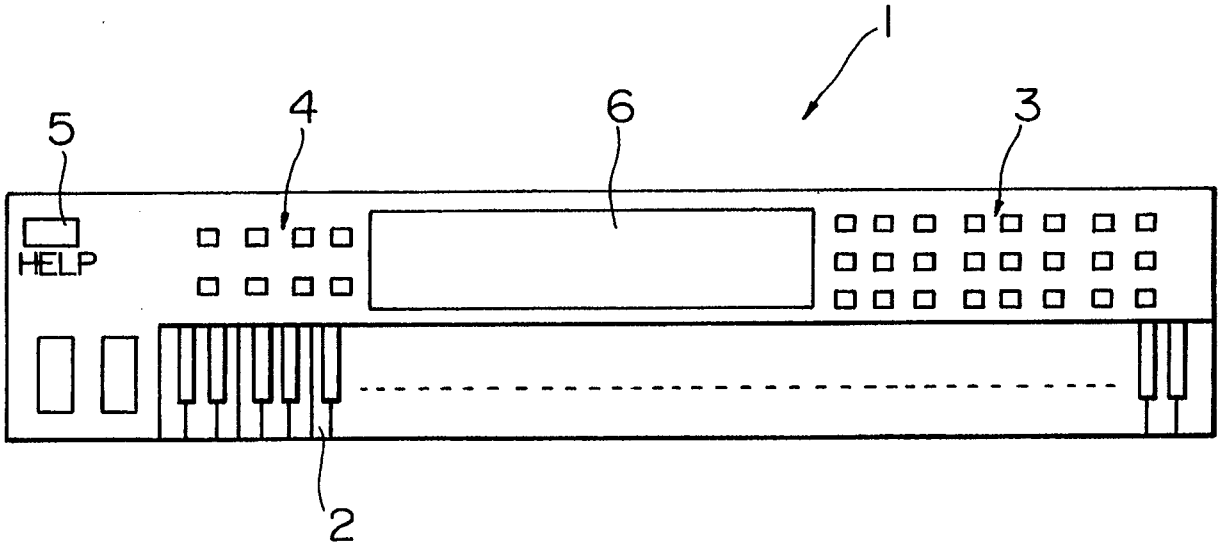
FIG. 1 is a plan view of an electronic musical instrument according to an embodiment of the present invention.

FIG. 1 is a plan view showing an electronic musical instrument according to an embodiment of the present invention. The electronic musical instrument 1 has a plurality of keyboard keys 2, a plurality of switches 3, special switches 4, a help switch 5 and a display 6. Each ordinary switch 3 is assigned a particular function. Each special switch 4 switches the functions of each ordinary switch 3 when the latter switch 3 is activated while the former switch is activated. The help switch 5 designates a help operation. The display 6 is made of a large LCD on which various information is displayed.

The switch 3 is a switch for providing a particular function (assigned to it) when it is activated singularly.

Each keyboard key 2 has a function of designating generation of particular musical tone when it is activated singularly. The switches 3 and keyboard keys 2 are called hereinafter "ordinary switches (OSW)" 2 and 3. The switches 3 include mode switches for setting or changing a current operation mode. OSWs 2 and 3 include, in addition to the keyboard keys, tone color switches, rhythm switches, edit switches and the like. The special switches 4 switches the functions of OSWs 2 and 3, and are called "special switches (SSW) 4. SSWs include tuning switch, transpose switch, MIDI switch, shift switch for designating alternative functions of the ordinary switches and the like. When the SSW 4 and OSW 2, 3 are activated at the same time, the function of OSW 2, 3 is switched to another function which is different from (or may be the same as) the original function when OSW 2, 3 is activated singularly.

For example, when such ordinary switches OSW 3 as plus or minus switch is operated, together with the transpose switch in the SSW 4, the value of transpose can be incremented or decremented.

Designation of an operation mode is achieved by activating a mode switch in the ordinary switches OSW and incrementing or decrementing the value in the operation mode register GM by manipulating a plus (+) switch or a minus (−) switch in the ordinary switches. The operation modes include, for examples, normal mode (GM=0), tone color edit mode (GM=1), automatic accompaniment setting mode (GM=2), automatic performance selling mode (GM=3), MIDI setting mode (GM=4), etc. When GM=1, such envelope generation parameters as "vibrato" and "attack rate" and such tone color parameter selecting functions as filter cut-off frequency are assigned to OSW. When GM=2, such functions "tempo", "style selection", "part on/off", and "variation" are assigned to OSW.

Figure 2:
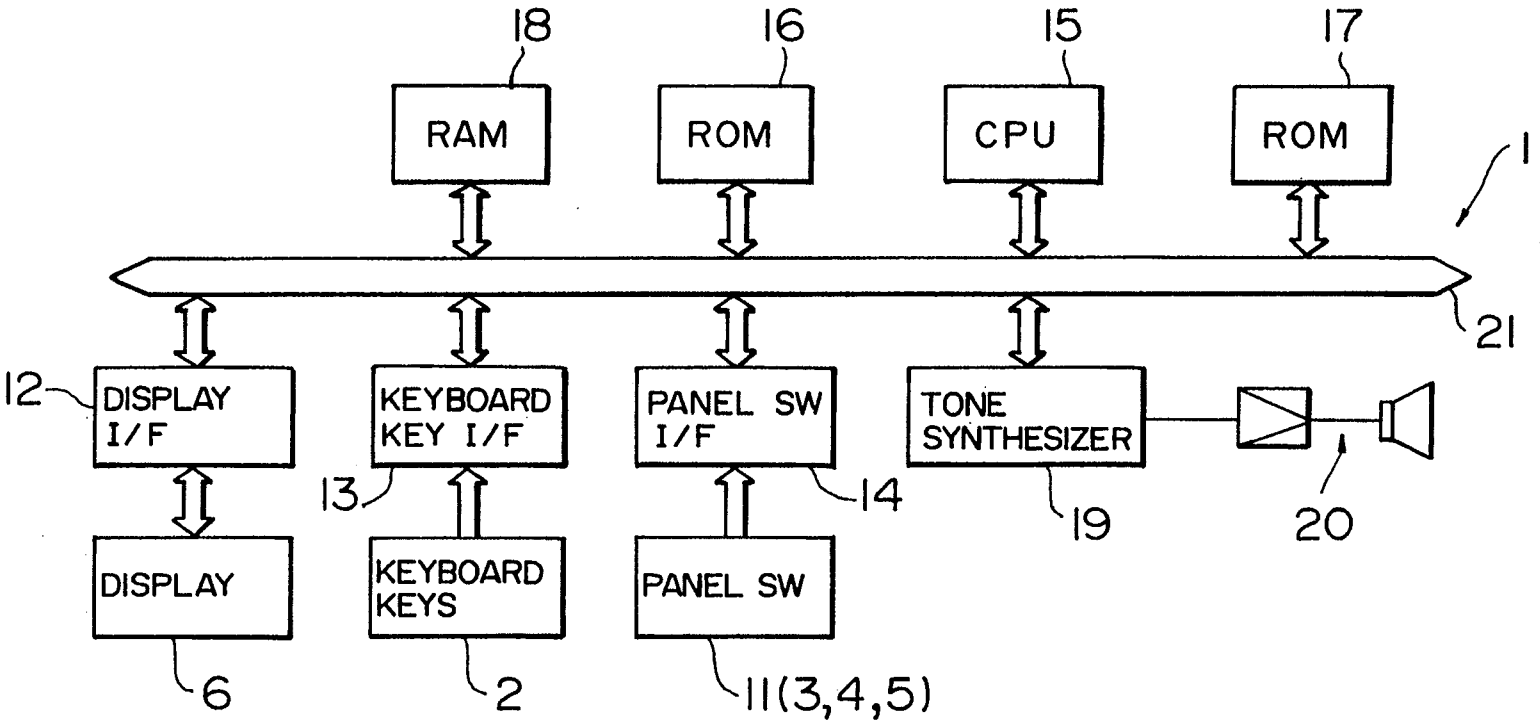
FIG. 2 is a block diagram showing the structure of the electronic musical instrument shown in FIG. 1.

FIG. 2 is a block diagram showing the structure of the electronic musical instrument. In FIG. 2, identical reference numerals denote like elements to those shown in FIG. 1. The electronic musical instrument 1 has a panel switch interface 14 for connecting panel switches 11 to a bus line 21, a keyboard interface 13 for connecting the keyboard keys 2 to the bus line 21, and a display interface for connecting the display 6 to the bus line 21. The panel switches 11 include switches 3, SSWs 4 and the help switch 5, respectively shown in FIG. 1. Also connected to the bus line 21 are a central processing unit (CPU) 15 for controlling the overall operation of the electronic musical instrument, a first read-only memory (ROM) 16 For storing programs to be executed by CPU 15, a second R0M for storing text data (help text data) explaining a function of each switch during the help operation and an address table of the text data, a random access memory (RAM) 18 to be used as work registers or the like, and a tone signal synthesizer 19 for synthesizing tone signals in accordance with instructions from CPU 15. A sound system 20 generates musical tones from tone signals supplied from the tone signal synthesizer.

Next, registers and flags used with this electronic musical instrument will be described. These registers and flags are set in RAM 18.

A help flag HF "1" indicates that a help operation is being designated, and "0" indicates that a help operation is not being designated.

An SSW number register n stores the switch number identifying a turned-on SSW 4. When none of SSWs 4 is being depressed, n is set to "0".

An SSW number temporary register nbuf stores the switch number identifying a turned-off SSW 4.

An OSW number register SBUF stores the switch number identifying a turned-on OSW 2, 3.

An OSW number temporary register SBG stores the switch number identifying the last turned-on OSW 2, 3.

A help text address register TA stores an address at which the text data to be displayed during the help operation is stored.

A routine address register RA stores an address of an entry point to a routine to be executed upon activation of each switch.

An operation mode register GM stores a value identifying an operation mode. The contents to be displayed on the display 6 change with an operation mode, and so the operation mode may be called a screen mode. GM takes "0" in a standard normal mode.

The names of registers and flags are assumed to indicate not only the registers and flags themselves but also their contents. For example, GM indicates not only the operation mode register itself but also the value of the operation mode stored in this operation mode register.

Next, tables used with this electronic musical instrument will be described.

Figure 3:
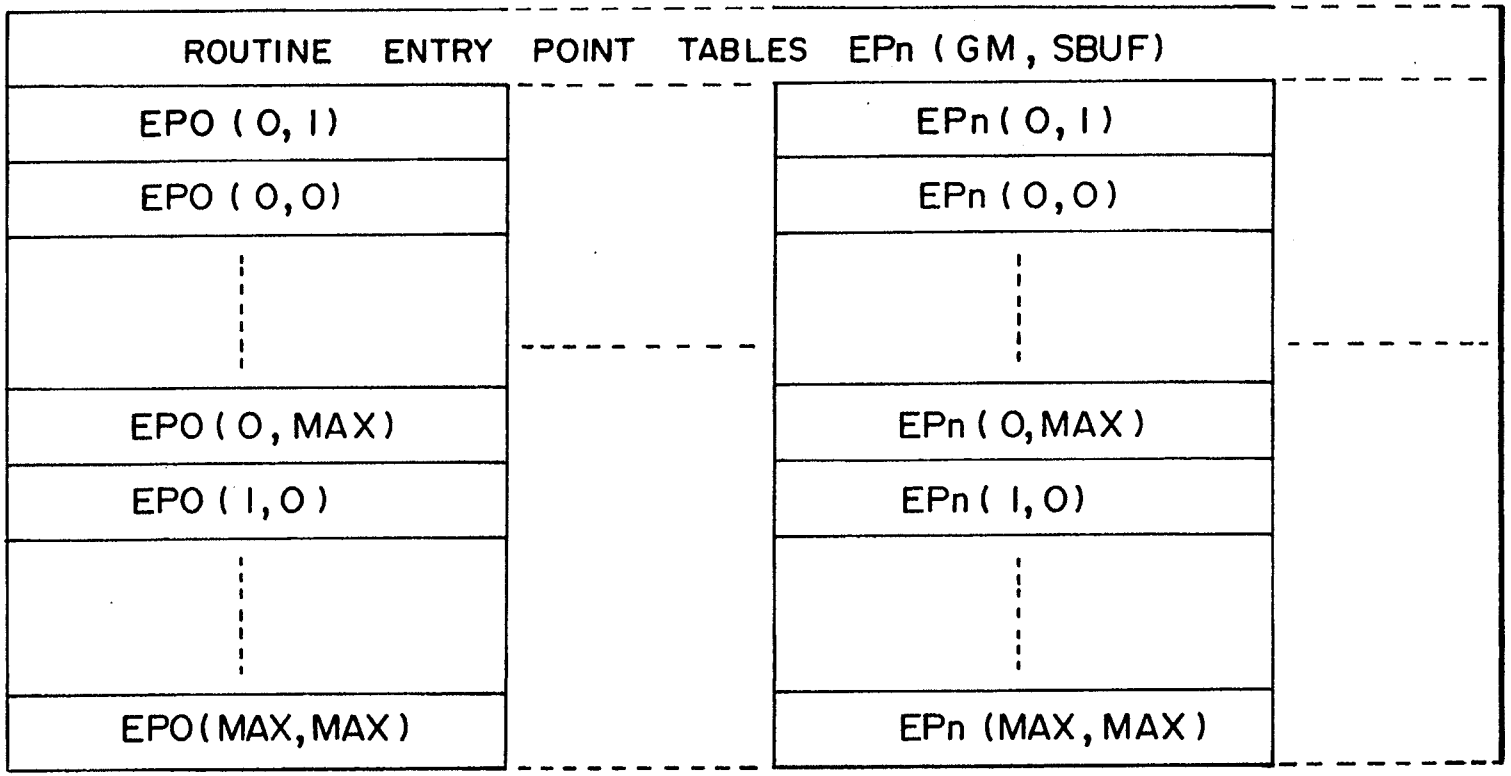
FIG. 3 is a memory map showing the contents of routine entry point tables.

A routine entry point table EPn is a table which stores entry points to routines, as shown in FIG. 3. When on-events of SSW4 and OSW 2, 3 occur at the same time, a table EPn having the SSW number n of the presently depressed SSW 4 (or last depressed SSW 4 if a plurality of SSWs are depressed) is selected. The data (address) EPn (GM, SBUF) is read from the table by using the present, operation mode GM and the turned-on OSW number SBUF, to call a sub-routine at the, read-out address. Namely, the address EPn (GM, SBUF) is the start address of a sub-routine program to be executed during the operation mode GM when both SSW 4 identified by the SSW number n (inclusive n="0" when no SSW 4 is depressed) and OSW 2, 3 identified by the OSW number SBUF are depressed at the same time. The routine entry point table EPn and sub-routine programs are stored in the first ROM 16.

Figure 4:
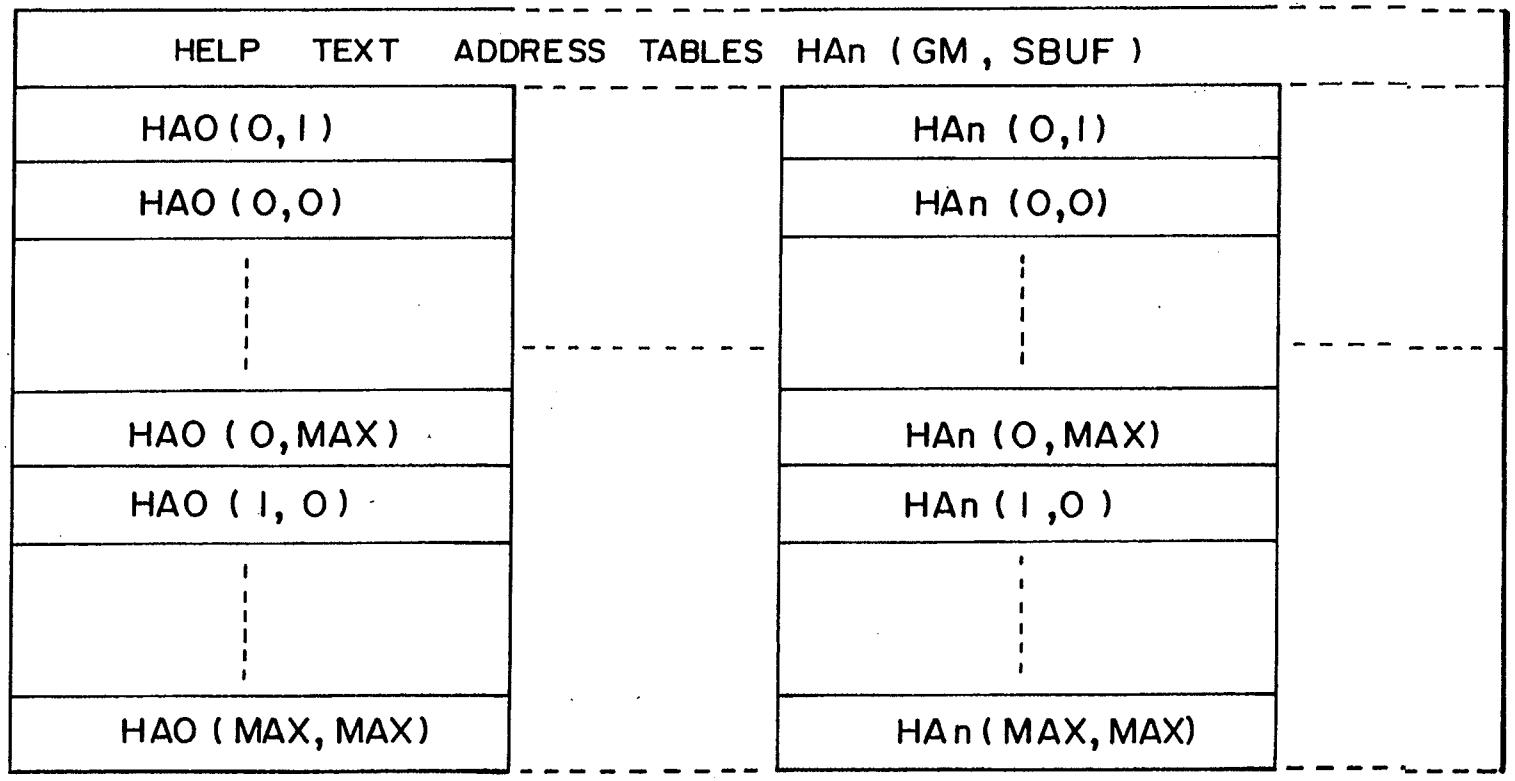
FIG. 4 is a memory map showing the contents of help text address tables.

A help text address table HAn stores memory addresses such as shown in FIG. 4, the memory address being read upon occurrence of on-events of SSW 4 and OSW 2, 3 while the help key 5 is depressed. A table HAn having the SSW number n of the presently depressed SSW 4 (or last depressed SSW 4 if a plurality off SSWs are depressed) is selected. The data (address) HAn (GM, SBUF) is read from the table by using the present operation mode GM and the turn-on OSW number SBUF, to display a help text stored at the read-out address. Namely, the address HAn (GM, SBUF) is the start address of a help text data for explanation of a function to be executed during the operation mode GM when both SSW 4 identified by the SSW number n (inclusive n="0" when no SSW 4 is depressed) and OSW 2, 3 identified by the OSW number SBUF are depressed at the same time.

Figure 5:
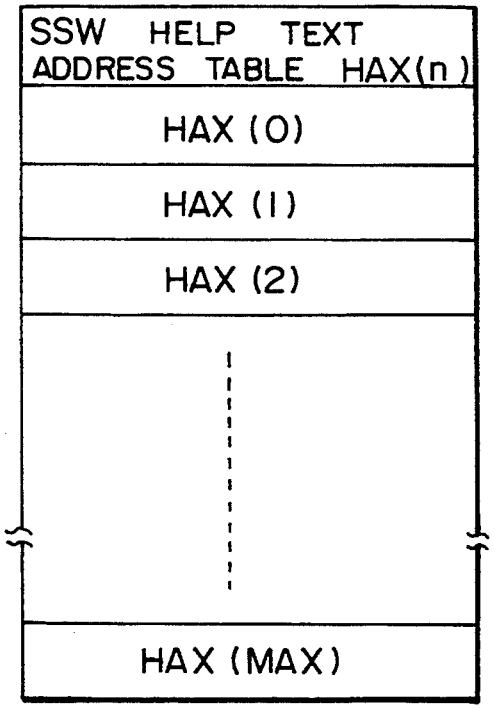
FIG. 5 is a memory map showing the contents of an SSW help text address table.

An SSW help text address table HAX stores memory addresses such as shown in FIG. 5, the memory address being read upon occurrence of an on-event of SSW 4 while the help key 5 is depressed. An element HAX (n) having the SSW number n of the presently depressed SSW 4 is selected to display an SSW help text stored at the read-out address. Namely, each HAX (n) stores the start address of a help text for the explanation of the depressed SSW 4 having the SSW number n. If no SSW 4 is depressed, n="0", and so the HAX (0) stores the address of display data not for the help operation but for the standard normal mode.

The help text address table HAn, SSW help text address table HAX and help text data are stored in the second ROM 17. Similar to the registers and flags, the names of tables and their elements are assumed to indicate not only tables and elements themselves but also the contents stored therein. For example, HAX (n) indicates not only the element storage area in the table but also the value of an SSW help text address stored in the storage area.

Next, the operation of the electronic musical instrument will be described with reference to the flow charts shown in FIGS. 6 to 12.

Figure 6:
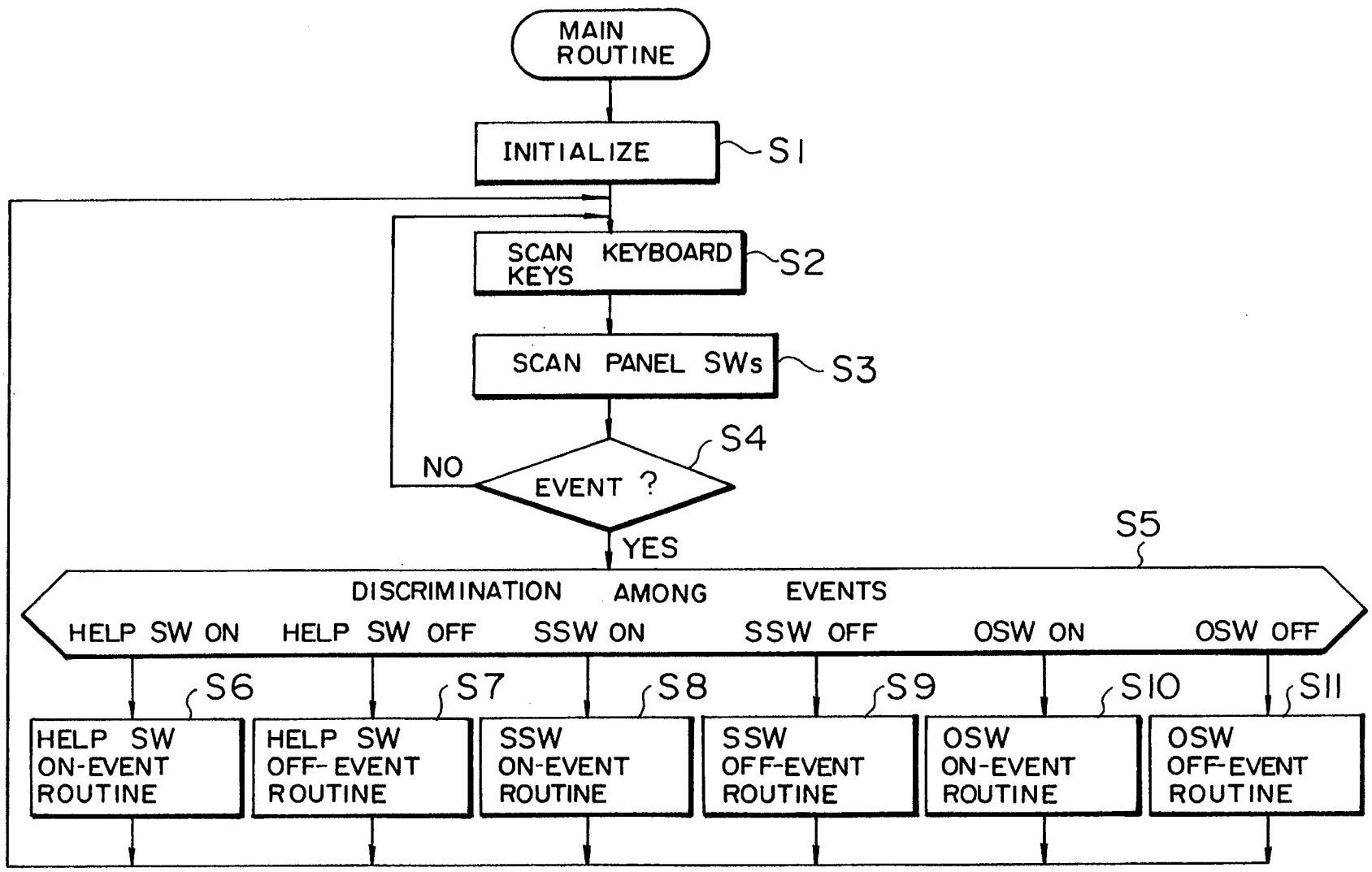
FIG. 6 is a flow chart showing a main routine of the electronic musical instrument shown in FIG. 1.

Referring to the main routine shown in FIG. 6, when the electronic musical instrument starts operating, registers and other circuit elements are initialized at step S1. The help flag HF is set to "0", and the operation mode register GM is set to "0" (normal mode). Next, at step S2 the keyboard keys 2 are scanned to check whether there is any key activation, and at step S3 the panel switches 11 (switches 3, SSWs 4, help switch 5, and the like) are scanned to check whether there is any activation. It is judged at step S4 from the scan results whether there is any event. If no event occurs, the control returns to step S2, and if there is an event, the event is identified at step S5.

If the event at step S5 is an on-event of the help switch, a help switch on-event routine is called at step S6 and thereafter the control returns to step S2. If the event at step S5 is a help switch off-event, a help switch off-event routine is called at step S7 and thereafter the control returns to step S2. IF the event at step S5 is an SSW on-event, an SSW on-event routine is called at step S8 and thereafter the control returns to step S2. If the event at step S5 is an SSW off-event, an SSW off-event routine is called at step S9 and thereafter the control returns to step S2. If the event at step S5 is an OSW on-event, an OSW on-event routine is called at step S10 and thereafter the control returns to step S2. If the event at step S5 is an OSW off-event, an OSW off-event routine is called at step S11 and thereafter the control returns to step S2. The above operations are repeated.

Figure 7:
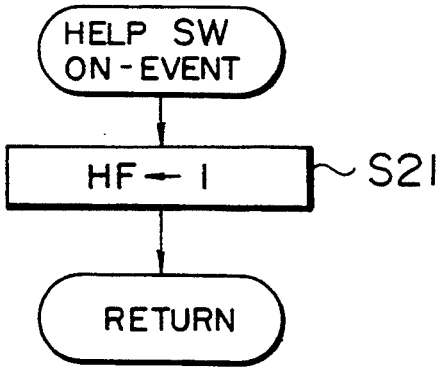
FIG. 7 is a flow chart showing a help switch on-event routine of the electronic musical instrument shown in FIG. 1.

Referring to the flow chart shown in FIG. 7, at the help switch on-event routine, the help Flag HF is set to "1" at step S21 to designate the help operation and thereafter return to step S2 of the main routine.

Figure 8:
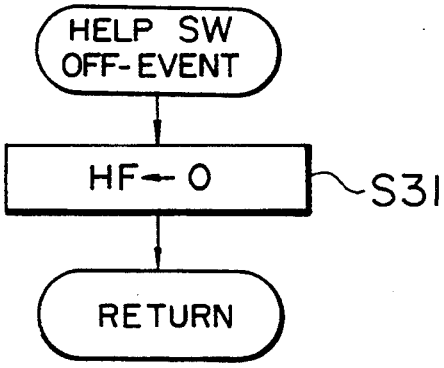
FIG. 8 is a flow chart showing a help switch off-event routine of the electronic musical instrument shown in FIG. 1.

Referring to the flow chart shown in FIG. 8, at the help switch off-event routine, the help flag HF is set to "0" at step S31 to return to the normal mode from the help operation and thereafter return to step S2 of the main routine.

Figure 9:
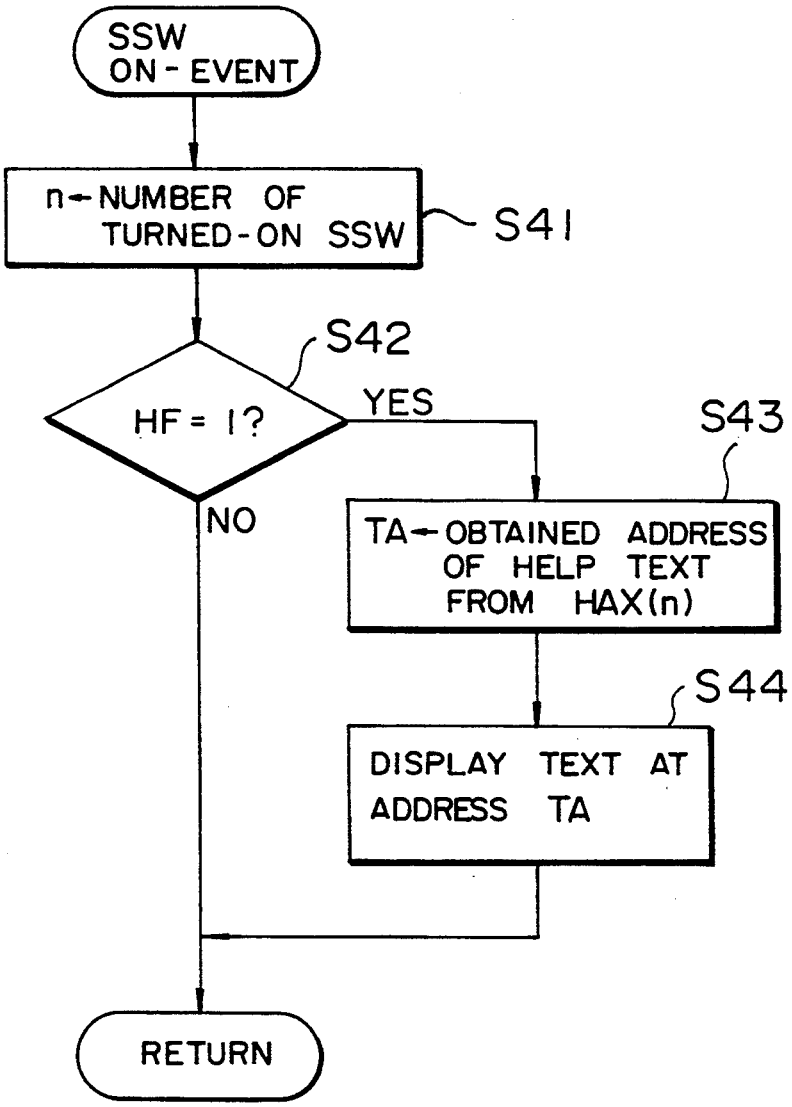
FIG. 9 is a flow chart showing an SSW on-event routine of the electronic musical instrument shown in FIG. 1.

Referring to the flow chart shown in FIG. 9, at the SSW on-event routine, First at step S41 the SSW number is stored in the SSW number register n, and at step S42 it is checked whether the help Flag HF is "1", i.e., whether the help operation has been designated. If the help flag HF is not "1", the control returns to step S2 of the main routine, because the activation of SSW only requires no particular operation. If the help flag HF is "1" at step 42, the address of a help text to be displayed is read at step S43 from the element HAX (n) of the SSW help text address table, and stored in the help text address register TA. Next, the help text at the help text address TA is read and displayed on the display 6 at step S44, and the control returns to step S2 of the main routine. In the above manner, when only SSW 4 such as a shift switch is depressed, the explanation of the switch is displayed on the display 6.

Figure 10:
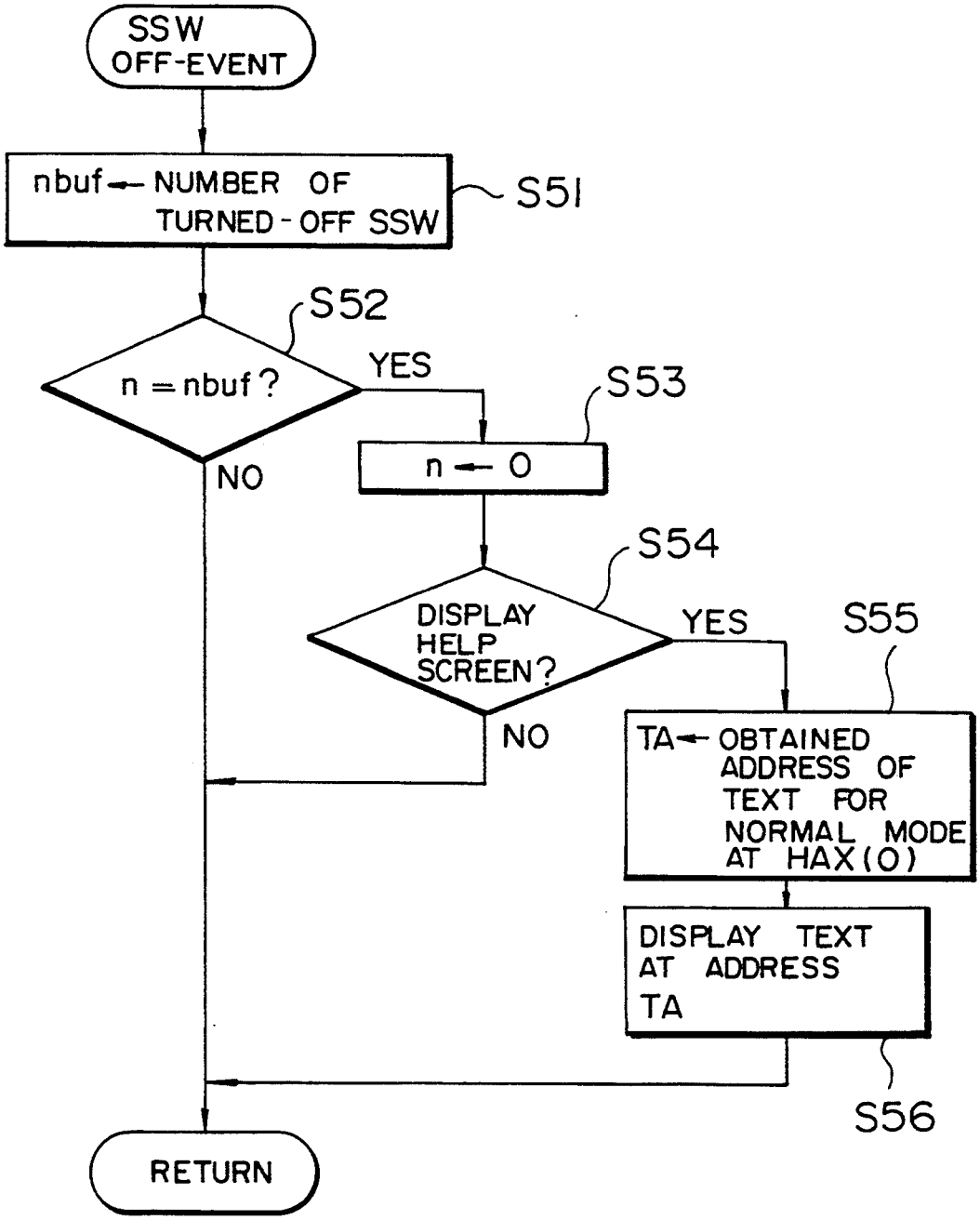
FIG. 10 is a flow chart showing an SSW off-event routine of the electronic musical instrument shown in FIG. 1.

Referring to the flow chart shown in FIG. 10, at the SSW off-event routine, first at step S51 the number of the turned-off SSW is stored in the SSW number temporary register nbuf. It is then checked at step S52 whether the SSW number n (the number of the last turned-on SSW) coincides with the turned-off SSW number nbuf. i.e., whether the last turned-on SSW was turned off. If not, the control returns to step S2 of the main routine. If the last turned-on SSW was turned off, the SSW number register n is set to "0" step S53, and it is checked at step S54 if the help screen is now being displayed. If not, the control returns to step S2 of the main routine. If the help screen is being displayed, at step S55 the address of screen display data in the standard normal mode is read from the element HAX (0) of the SSW help text address table, and stored in the register TA. Next, at step S56, the screen display data in the normal mode at the address TA is read and displayed on the display, and the control returns to step S2 of the main routine. In the above manner, when a SSW 4 is turned off, the screen display data in the standard normal mode is displayed on the display 6.

Figure 11:
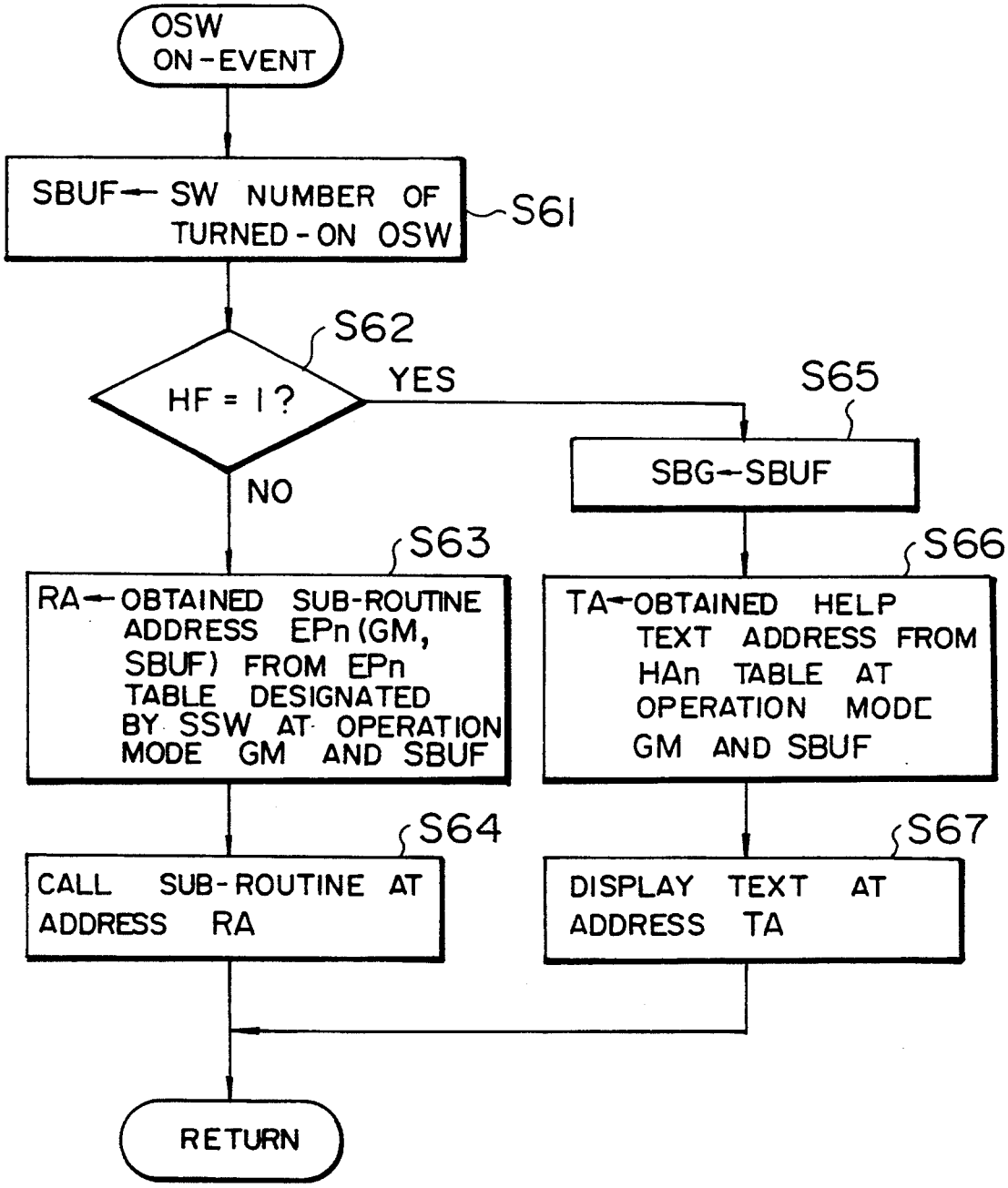
FIG. 11 is a flow chart showing an OSW on-event routine of the electronic musical instrument shown in FIG. 1.

Referring to the flow chart shown in FIG. 11, at the OSW on-event routine, first at step S61 the number of the turned-on OSW is stored in the OSW number register SBUF, and it is checked at step S62 whether the help flag HF is "1", i.e., whether the help operation has been designated. IF the help flag HF is not "1", the control advances to step S63 because a particular operation is required to be executed, which operation is identified from the turned-on OSW and SSW (inclusive of n="0" when SSW is not turned on) and the operation mode.

At step S63 the address of a sub-routine to be executed is read from the element EPn (GM, SBUF) of the routine entry point table the element corresponding to the SSW number n, operation mode Gtt, and OSW number SBUF. The address is stored the routine address register RA. Next, at step S64 the subroutine at the routine address RA is called to execute the particular operation, and thereafter the control returns to step S2 of the main routine. Sub-routines to be called include a subroutine of generating a musical tone signal when a keyboard key 2 is depressed during the normal mode (GM="0") without depressing an SSW 4 (n="0"), a sub-routine of setting and changing the value of the operation mode register GM when a particular mode switch is depressed, and other sub-routines.

If the help flag HF is "1" at step S62, the number SBUF the turned-on SSW is temporarily stored in the OSW temporary register SBG at step S65. Next, at step S66 the address of a help text to be displayed is read from the element HAn (GM, SBUF) of the help text address table, in accordance with the present operation mode GM, SSW number n identifying the depressed SSW, and the OSW number SBUF identifying the depressed OSW, and stored in the help address register TA. At step S67 the help text at the help text address TA is read and displayed the display 6, and the control returns back to step S2 of the main routine. In the above manner, when an OSW 2, 3 is depressed, the explanation of the function of a depressed OSW is operation mode and the depressed SSW.

Figure 12:
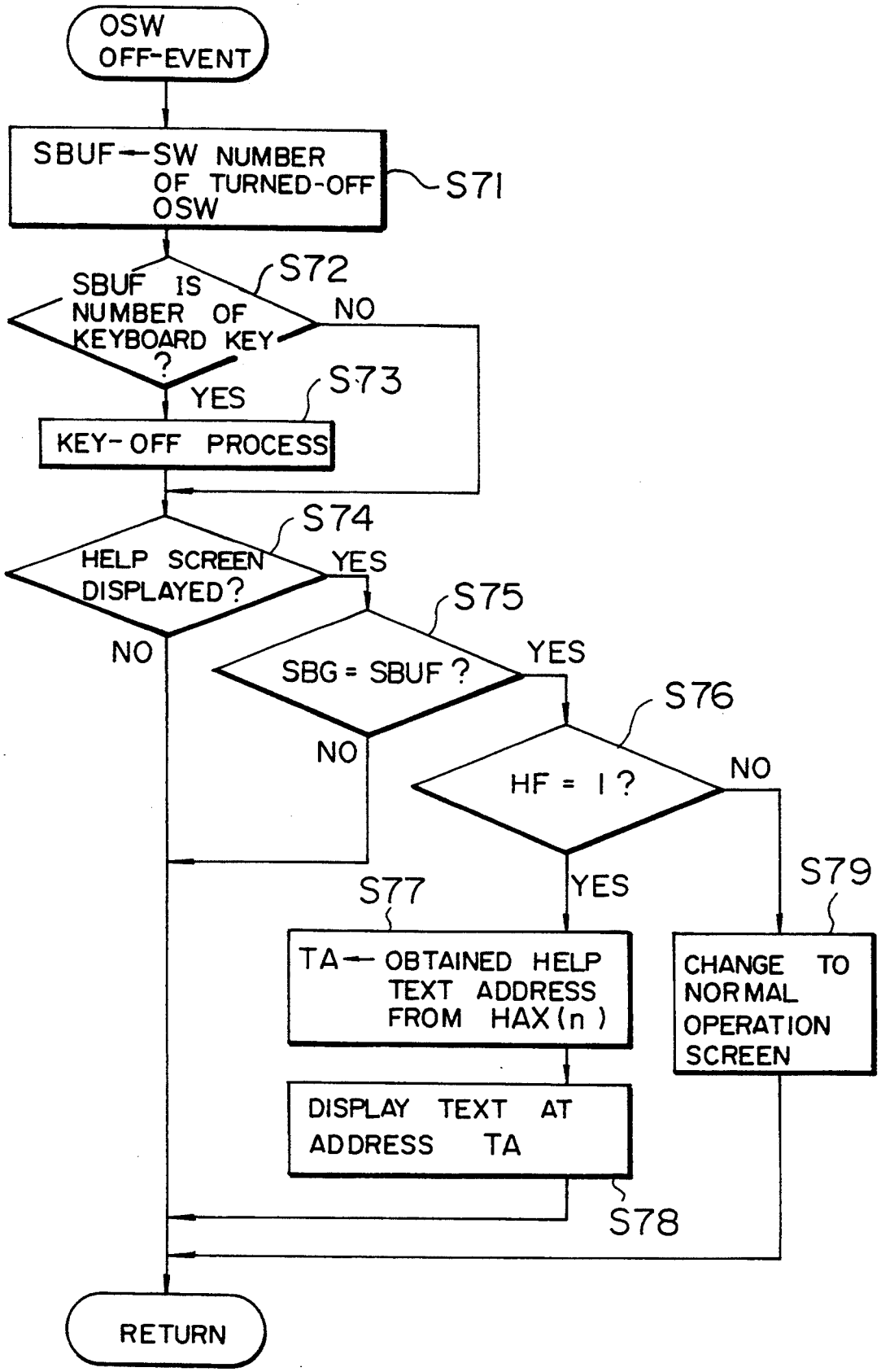
FIG. 12 is a flow chart showing an OSW off-event routine of the electronic musical instrument shown in FIG. 1.

Referring to the flow chart shown in FIG. 12, at the OSW of, off-event routine, first at step S71 the number of the turned-off OSW is stored in the OSW number register SBUF, and it checked at step S72 whether the turned-off OSW number SBUF corresponds to the number of any keyboard key 2. In the case of an off-event of the keyboard key 2, a key-off process is executed at step S73 and the control advances to step S74. In the case of an off-event of an OSW other than the keyboard key 2, the control directly advances to step S74. It is checked at step S74 whether a help screen is now being displayed. If not, the control returns to step S2 of the main routine. If a help screen is being displayed, It is checked at step S75 whether the temporarily stored OSW number (last turned-on OSW number) SBG coincides with the turned-off OSW number SBUF, i.e. , whether the last turned-on OSW was turned off. If not, the control returns to step S2 of the main routine. If the last turned-on OSW was turned off, it is checked at step S76 whether the help flag HF is "1".

If the help flag HF is "1" at step S76, there is a possibility that an SSW is still being depressed, so that the control advances to step S77 in order to display the help text for the SSW. At step S77, the address of the help text to be displayed is read from the element HAX (n) of the SSW help text address table, and stored in the help text address register TA. Next, at step S78, the help text at the help text address TA is read and displayed on the display 6, and the control returns to step S2 of the main routine. In the above manner, a help text of the depressed SSW is displayed on the display 6.

If the help flag HF is not "1" at step S76, the normal mode screen is displayed at step S79, and thereafter the control returns to step S2 of the main routine.

As described above, when both or one of SSW 4 and OSW 2, 3 is depressed without depressing the help key 5, a predetermined sub-routine in the operation mode at that time is executed to provide the function of the depressed SSW 4 and/or OSW 3. When SSW 4 or OSW 2, 3 is activated while the help key 5 is depressed, the explanation of the function specific to the depressed SSW 4 or OSW 3 is displayed.

FIGS. 13A to 13D show examples of help screens on the display 6 during the help operation. FIG. 13A shows the explanation of a tuning switch which is one of SSWs 4. This help screen is an example of displays obtained when the help switch 5 and tuning switch are depressed at the same time. FIG. 13B shows the explanation of a violin switch which is one of OSWs 3. This help screen is an example of displays obtained when the help switch 5 and violin switch are depressed at the same time. FIG. 13C shows the explanation of the function to be realized when the shift switch and violin switch are depressed at the same time during a first edit mode. This help screen is an example of displays obtained when the shift switch and violin switch are depressed at the same time during the first edit mode. FIG. 13D shows the explanation of a MIDI switch which is one of SSWs 4. This help screen is an example of displays obtained when the help switch 5 and MIDI switch are depressed at the same time.

In the above embodiments, the help operation is designated while the help switch 5 is depressed, and the help operation designation is released while the help switch is not depressed. A toggle switch may be used as the help switch. In this case, the help operation designation and its release are alternately switched each time the toggle switch is depressed.

In this context, however, an electronic musical instrument has a number of switches having various functions and a number of operation modes. Therefore, if the help mode is allowed to continue for a significant time period, the operation mode becomes to have a hierarchical structure during this time period, resulting in complicated processing. It is preferable to designate the help operation only during the period while the help switch is depressed as in the above embodiments.

In the above embodiments, a help text is erased when a switch is turned on or off after the text is once displayed. The help text may be automatically erased after a predetermined time lapse. Furthermore, if a help text cannot be displayed at a time within the restricted area of the display screen, it may be arranged to be sequentially displayed in response to depressions of an optional switch (e.g., an enter key). The display may use an LCD, CRT or the like which may be built in an electronic musical instrument or externally installed. Although help texts are stored in ROM in the above embodiments, they may be stored in RAMs, or external storage devices such as memory cards and floppy discs. If such external storage devices are used, help texts written in different languages or having the detailed and simple explanations can be selectively used depending upon the usage conditions of special switches.

When the switching means is activated while the help operation is designated, the explanation of the function assigned to the switching means in a current operation mode is displayed on the display means, without executing the function assigned to the switching means. Therefore, the function of each switch can be known by a very simple switch manipulation, even for an electronic musical instrument having various operation modes and a number of switches to be operated singularly or in combination to realize a different function. A voluminous manual is not therefore necessary, and a short and compact manual is sufficient. Furthermore, the function of each switch can be known without the help of a manual, thereby providing an improved operability and versatility.

Although the present invention has been described in connection with the preferred embodiments, it is not intended to be limited only to the above-described embodiments. For example, various changes, variations, combinations, improvements and the like are obvious to those skilled in the art without departing from the spirit and scope of the present invention.

I claim:

1. An electronic musical instrument comprising:

operation mode designating means for designating an operation mode among a plurality of operation modes, each defining how said electronic musical instrument operates;

a plurality of operation means, each being assigned different functions with respect to said plural operation modes;

display means for displaying information;

help designating means for designating a help operation; and control means response to activation of said operation means while said help operation is designated, for controlling said display means to display an explanation of a function assigned to said activated operation means in said operation mode, without executing said function.

2. An electronic musical instrument according to claim 1, wherein said plurality of operation means include a plurality of operation members, one of which is said activated operation means, and said function is executed when another operation member other than said activated operation member is activated at the same time as said activated operation means.

3. An electronic musical instrument according to claim 1, wherein said plurality of operation means include ordinary operation members and special operation members, one of said special operation members being said activated operation means and said function being executed only when one of said ordinary operation members is activated at the same time as said activated operation member.

4. An electronic musical instrument according to claim 1, further including a memory for storing explanation data for said explanation.

5. An electronic musical instrument according to claim 4, wherein said memory includes tables classified in accordance with the usage conditions of said special operation members.

6. An electronic musical instrument according to claim 5, wherein each of said tables stores data in accordance with said operation mode and said ordinary operation members.

7. An electronic musical instrument comprising:

operation mode designating means for designating an operation mode among a plurality of operation modes, each defining how said electronic musical instrument operates;

a plurality of operation means, each being assigned different functions with respect to said plural operation modes, said plurality of operation means including ordinary operation members and special operation members;

display means for displaying information;

help designating means for designating a help operation;

control means responsive to activation of said operation means while said help operation is designated, for controlling said display means to display an explanation of a function assigned to said activated operation means in said operation mode, without executing said function, one of said special operation members being said activated operation means and said function being executed only when one of said ordinary operation members is activated at the same time as said activated operation means; and a memory for storing explanation data for said explanation, said memory including tables classified in accordance with the usage conditions of said special operation members, each of said tables storing data in accordance with said operation mode and said ordinary operation members; and wherein said ordinary switches include keyboard keys, tone color operation members and rhythm operation members.

8. An electronic musical instrument comprising:

operation mode designating means for designating an operation mode among a plurality of operation modes, each defining how said electronic musical instrument operates;

a plurality of operation means, each being assigned different functions With respect to said plural operation modes, said plurality of operation means including ordinary operation members and special operation members;

display means for displaying information;

help designating means for designating a help operation;

control means responsive to activation of said operation means while said help operation is designated, for controlling said display means to display an explanation of a function assigned to said activated operation means in said operation mode, without executing said function, one of said special operation members being said activated operation means and said function being executed only when one of said ordinary operation members is activated at the same time as said activated operation means; and a memory for storing explanation data for said explanation, said memory including tables classified in accordance with the usage conditions of said special operation members, each of said tables storing data in accordance with said operation mode and said ordinary operation members; and wherein said special operation members include tuning operation members and shift operation members.

9. An electronic musical instrument comprising:

operation mode designating means for designating an operation mode among a plurality of operation modes, each defining how said electronic musical instrument operates;

a plurality of operation means, each being assigned different functions with respect to said plural operation modes, one of said different functions being to designate a tone pitch, a tone color, a tone sounding start, a music piece or a performance pattern;

display means for displaying information;

help designating means for designating a help operation; and control means responsive to activation of said operation means while said help operation is designated, for controlling said display means to display an explanation of a function assigned to said activated operation means in said operation mode, without executing said function.

* * * * *